United States Patent [19]

Johnson

[11] 4,320,712

[45] Mar. 23, 1982

[54] THREAD HANDLING

[75] Inventor: Ralph E. Johnson, Convent Station, N.J.

[73] Assignee: The Singer Company, Stamford, Conn.

[21] Appl. No.: 49,680

[22] Filed: Jun. 18, 1979

[51] Int. Cl.[3] ..... D05B 1/12; D05B 49/00

[52] U.S. Cl. ..... 112/184; 112/245; 112/262.1

[58] Field of Search ..... 112/181, 184, 241, 245, 112/247, 248, 255, 262.1

[56] References Cited

U.S. PATENT DOCUMENTS

| | | | |
|---|---|---|---|
| 1,129,588 | 2/1915 | Onderdonk | 112/241 |
| 1,548,464 | 8/1925 | Hemleb | 112/181 |
| 2,173,320 | 2/1939 | DeVoe | 112/241 |
| 2,400,602 | 5/1946 | Rubel | 112/248 |
| 2,853,036 | 2/1958 | Enos | 112/262.1 X |
| 3,012,529 | 12/1961 | Ketterer et al. | 112/181 |
| 3,083,661 | 4/1963 | Patrick | 112/242 |
| 3,476,067 | 11/1969 | Johnson | 112/241 X |
| 3,587,495 | 6/1971 | Johnson | 112/184 |

FOREIGN PATENT DOCUMENTS

| | | | |
|---|---|---|---|
| 332150 | 3/1972 | U.S.S.R. | 112/181 |

*Primary Examiner*—Wm. Carter Reynolds
*Attorney, Agent, or Firm*—Elliot A. Lackenbach; Robert E. Smith; Edward L. Bell

[57] ABSTRACT

A thread handling device is disclosed in a type 301 lockstitch rotary hook loop taker sewing machine having a three-to-one hook to arm shaft ratio for controlling and metering slack needle thread prior to needle penetration to prevent the thread from wrapping around the point of the needle, which could prevent loop seizure, break the thread, or interfere with correct stitch formation. The thread is guided between two stationary members, with the controller between the members, the controller comprising an edge attached to the needle bar drive connecting link, moving with it, and only engaging the thread as the take-up and needle bar descend, providing a lengthened thread path prior to needle penetration.

9 Claims, 4 Drawing Figures

THREAD HANDLING

DESCRIPTION

Field of the Invention:

This invention relates to sewing machines, and more particularly, to thread handling therein and finds particular utility for controlling and metering needle thread slack prior to needle penetration in a two-thread type 301 lockstitch sewing machine and especially such machine having a rotary hook driven at a three to one ratio relative the arm shaft rotation.

BACKGROUND OF THE INVENTION

In a conventional type 301 lockstitch sewing machine, one of the major difficulties is in the timing relationships existent between the needle thread take-up, the loop taker operation for stitch concatenation and the feed timing and duration, each of which take time in the machine cycle. Needle thread take-up, loop formation, loop expansion, loop extraction and feed each require separate and distinct portions of the machine cycle, with preferably no overlap. For this reason, loop seizure by the loop taker has to be coordinated with the needle bar and the take-up and loop extraction has to be coordinated with cast off of the loop from the loop taker. The feed time must also be related to the take-up, it must start at a time when the feed dog is up and must continue beyond the time the take-up is up. The handling of the needle thread is also critical in that the thread demand for loop formation and for expansion by the loop taker must be coordinated with the thread supply from the take-up.

Most current commercial rotary hook lockstitch sewing machines use a two to one ratio of loop taker to arm shaft rotation so that the loop taker revolves twice for every complete cycle of the needle bar. Cast off of the needle thread from the loop taker following concatenation of the needle thread around the bobbin thread occurs after almost 270 degrees of machine arm shaft rotation from the "needle up" position. The time from loop seizure to cast off takes about 110 degrees of arm shaft rotation. A ratio of loop taker to arm shaft rotation of three to one, however, enables the machine to approach cast off in only 70 degrees of machine arm shaft rotation after loop seizure instead of 110 degrees, a gain of 35 degrees that can be used, for example, to complete feeding earlier in a machine cycle. Since the feed time is related to the needle timing, the net effect is a gain in capacity to sew heavy materials, the difference being from a capacity of about 1/16 inch material in a conventional consumer type sewing machine having a two-to-one hook to arm shaft ratio, to a capacity of about $\frac{1}{4}$ inch thick material using a three-to-one ratio. That is, before the needle reaches the material, even if the material is $\frac{1}{4}$ inch thick, in a three to one ratio machine the feed is completed. This potential for increase has been previously recognized and is discussed, for example, in Hemleb, U.S. Pat. No. 1,583,925 dated May 11, 1926.

In advancing the feed, needle bar drive and take-up relative the loop taker, however, the take-up also starts its descent earlier and pays out needle thread faster than the needle bar demand, providing slack thread. If this slack thread is not controlled prior to needle penetration, the thread can wrap around the needle point, prevent loop siezure, break the thread, or interfere with correct stitch formation. Following needle penetration, however, substantial needle thread needs to be subsequently metered out for loop seizure and expansion to pass around the bobbin. Various prior art 3 to 1 machines used various methods to control the needle thread, such as complex rotary take-ups or lengthened needle bars, each of which required substantial changes from the currently prefered crank driven take-up design.

OBJECTS OF THE INVENTION

Bearing in mind the foregoing, it is a primary object of the present invention to provide novel and improved methods of and apparatus for thread handling, particularly for controlling and metering slack needle thread in a lockstitch sewing machine prior to needle penetration.

Another primary object of the present invention, in addition to the foregoing objects, is the provision of novel and improved thread metering and slack control for the needle thread of a lockstitch sewing machine which is economical to manufacture and durable and effective in use.

Yet another primary object of the present invention, in addition to each of the foregoing objects, is the provision of a novel and improved needle thread metering and slack control device for use with a crank operated needle thread take-up operative for taking up excess slack prior to needle penetration and metering out additional thread to the needle subsequent thereto.

Yet another primary object of the present invention, in addition to each of the foregoing objects, is the provision of novel and improved methods of and apparatus for thread handling in a sewing machine, particularly a sewing machine having a hook to arm shaft rotation ratio of three-to-one.

Another and yet still further primary object of the present invention, in addition to each of the foregoing objects, is the provision of a novel and improved needle thread slack control and metering device for a sewing machine, carried by the needle bar drive connecting link.

Yet still another and further primary object of the present invention, in addition to each of the foregoing objects, is the provision, in a lockstitch sewing machine, of a thread control cam or device carried by the needle bar connecting link cooperating with a pair of fixed needle thread guides on the machine bracket arm for needle thread slack control and metering.

Yet another and still further primary object of the present invention, in addition to each of the foregoing objects, is the provision of novel and improved methods of and apparatus for thread control providing finely controlled and minimal needle thread tension throughout the machine cycle.

A yet further primary object of the present invention, in addition to each of the foregoing objects, is the provision of novel and improved sewing machines having capacity for increased thicknesses of material, without any lengthening of the needle bar stroke and using a crank operated take-up.

It is a feature of the present invention that the novel and improved thread controller and metering device hereof is driven in common with the needle bar while yet being active only during needle bar descent.

The invention resides in the combination, construction, arrangement and disposition of the various component parts and elements incorporated in improved lockstitch sewing machines and thread handling methods and apparatus in accordance with the principles of this invention. The present invention will be better understood and objects and important features other than those specifically enumerated above will become apparant when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention, a thread handling device is provided in a type 301 lockstitch rotary hook loop taker sewing machine having a three-to-one hook to arm shaft ratio for controlling and metering slack needle thread prior to needle penetration. If this slack thread is not properly controlled and metered, the thread can wrap around the point of the needle, prevent loop seizure, break the thread, or interfere with correct stitch formation. In accordance with the present invention the thread is guided between two stationary members, with the controller between the members engaging the thread during needle descent to lengthen the thread path prior to needle penetration, taking up slack thread thereby, and subsequently retracting to meter thread out to the needle. The controller is attached to the needle bar drive connecting link, moves with it, and only engages the thread as the take-up and needle bar descend.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

DETAILED DESCRIPTION OF THE INVENTION

Figure 2:
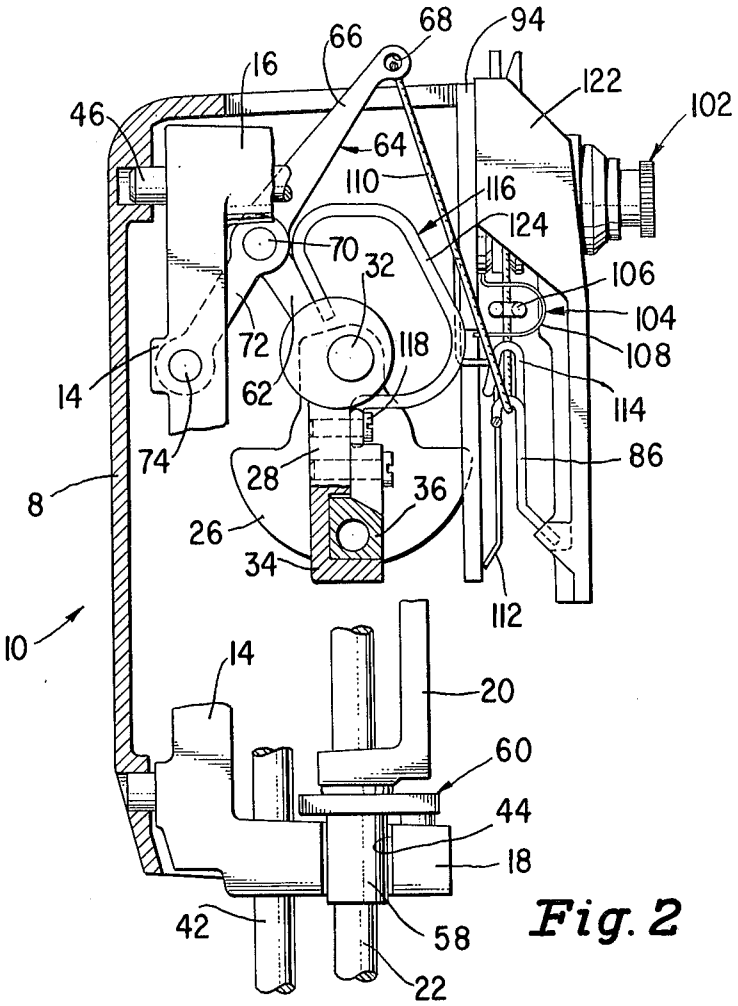
FIG. 2 is a side elevational slightly enlarged cross-sectional view taken along line 2—2 of FIG. 1, and partially broken away, of the machine of FIG. 1 at the top dead center position of the arm shaft with the needle and needle thread take-up at their highest positions above the sewing machine bed and at the start of a stitch forming cycle.

With reference now to the drawing, there is shown and illustrated the head end portion 6 of a Federal stitch type 301, two thread lockstitch sewing machine constructed and arranged and incorporating means for thread handling in accordance with the principles of the present invention and comprising a cast rear casing section 8 to which various modular sub-assemblies may be mounted and covered by one or more front panel cover members, not shown, as set forth in my co-pending application Ser. No. 971,962 filed Dec. 21, 1978, now U.S. Pat. No. 4,193,361 dated Mar. 18, 1980 assigned to the assignee of the present application and hereby incorporated herein by reference as fully and completely as if reproduced hereat.

Reference characters 10 and 12 designate, respectively, the head end portion of the bracket arm and the work supporting or bed portion of the machine. The head end portion 10 of the bracket arm includes a fixed support bracket 14 having an upper extending arm 16 and a lower extending arm 18 which support a needle bar bracket 20.

A needle bar 22 is supported in the bracket 20 for endwise reciprocation by an arm shaft 24 journalled for rotation in the bracket arm 10; acting through a counterbalanced crank 26, a connecting drive link 28, and a needle bar collar 30. The crank 26 drives one end of the needle bar connecting drive link 28 through an actuating crank pin 32. The needle bar connecting drive link 28 carries a raceway member 34 which slidably carries a compensating needle bar operating crank 36 operatively connected with the needle bar collar 30. Further details of the needle bar drive and the compensating needle bar operating crank 36 are disclosed in further detail in my co-pending application Ser. No. 49,679, filed concurrently herewith, assigned to the assignee of the present application, and incorporated herein by reference as fully and completely as if reproduced hereat. An eye pointed needle 38 is carried by the lower end portion of the needle bar 22 and cooperates with a rotary hook loop taker 23 journalled in the bed portion 12 and driven by means, not shown, in timed relationship to the arm shaft 24 and at a three-to-one ratio relative thereto for concatenating the needle thread, around a bobbin thread, not shown, for stitch formation.

A presser foot 40, affixed to a presser bar 42, is utilized to urge fabric into contact with the feeding mechanism (not shown) in the bed portion 12 of the machine. The needle bar 22 extends through an eliptical opening 44 in the arm 18 of the fixed bracket 14, which opening is of sufficient size to permit zig-zag movements of the needle bar 22 in response to reciprocatory actuation of the needle bar supporting bracket 20 by needle bight control means causing the bracket to pivot at its upper end on a shaft 46. Substantially any desired needle bight control means may be utilized but preferably a needle bight control means similar to that disclosed in my co-pending application Ser. No. 971,963 filed Dec. 21, 1978, now U.S. Pat. No. 4,188,895, assigned to the assignee of the instant application, and incorporated herein by reference as fully and completely as if reproduced hereat may be used which, as shown, includes an actuating link 48 shown pivotally connected to the needle bar bracket 20 by a fulcrum screw 50, and a return spring 52 having one end restrained by a screw 54 and an intermediate portion partially wrapped about the shaft 46, the screw 56 and shaft 46 defining fixed locations in the bracket arm head end portion 10 fixedly positioning the spring relative thereto. The other end of the spring 52 is in engagement with an abutment 56 on the needle bar bracket 20 urging the bracket to the right as viewed in FIG. 1.

Figure 3:
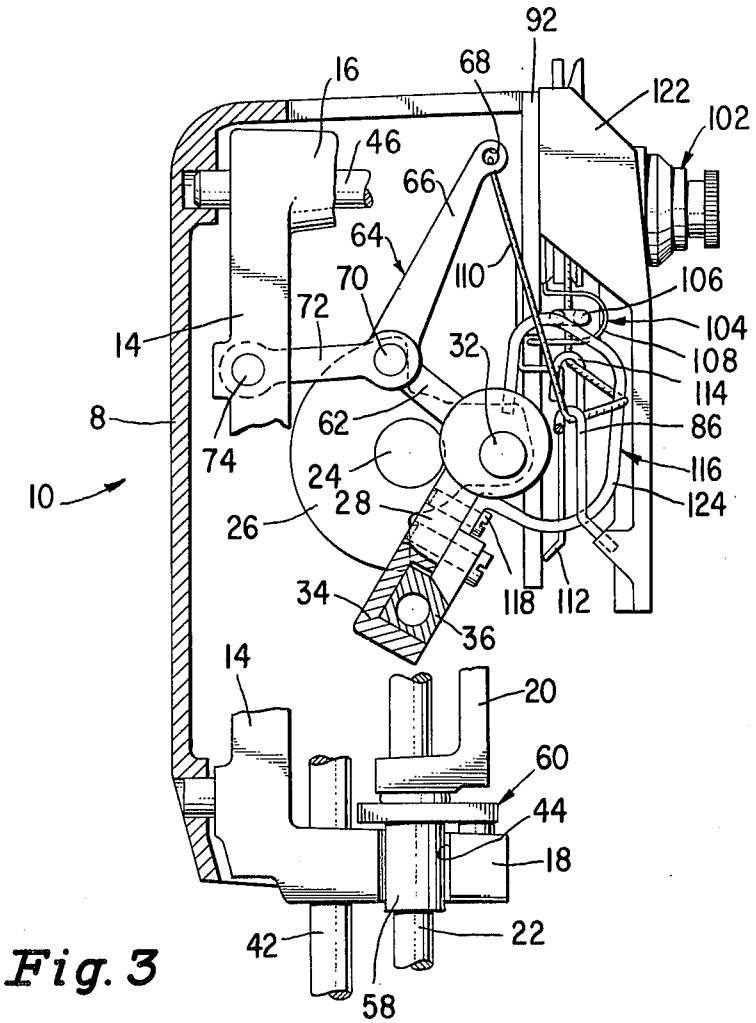
FIG. 3 is a side elevational cross-sectional view, partially broken away, similar to FIG. 2 illustrating the component orientation after 90 degrees rotation of the arm shaft from the position of FIG. 2.

The needle bar 22 is supported between the lower end of the needle bar bracket 20 and the arm 18 of the fixed bracket 14, in the sleeve 58 of a spherical bearing 51 (see FIGS. 2 and 3). Further details of the needle bar suspension means are disclosed in my co-pending application Ser. No. 915,084 filed June 12, 1978, assigned to the assignee of the present application, and hereby incorporated by reference herein as fully and completely as if reproduced hereat.

The crank pin 32 is also embraced by one arm 62 of a take-up lever 64 and the other arm 66 of the take-up lever 64 is provided with a thread eyelet 68. The take-up lever 64 is pivoted, as at the juncture of the arm 62 and 66 on a fulcrum pin 70 to an anchor link 72 fulcrumed on a pin 74 carried by the fixed support bracket 14.

As heretofore pointed out, the sewing machine of the present invention preferably comprises a plurality of sub-assemblies mounted with the casting 8 in a manner set forth in my co-pending application Ser. No. 971,962. The presser and needle bar sub-assembly includes a flat rigid plate 76 mounted with the machine cast rear casing section 8 by the screw 54 and a further screw 78. The flat rigid plate 76 is also mounted with the fixed support bracket 14 by means of screws 80 and 82. Carried on the flat rigid plate 76 is a thread guide 84 having a thread guiding portion 86 of generally inverted U-shaped configuration and a mounting portion 88 enabling the thread guide 84 to be rigidly mounted with the flat rigid plate 76 as by means of a clamp member 90 secured by screws 92. The guide 84 may, as shown, be fabricated of formed wire.

Figure 1:
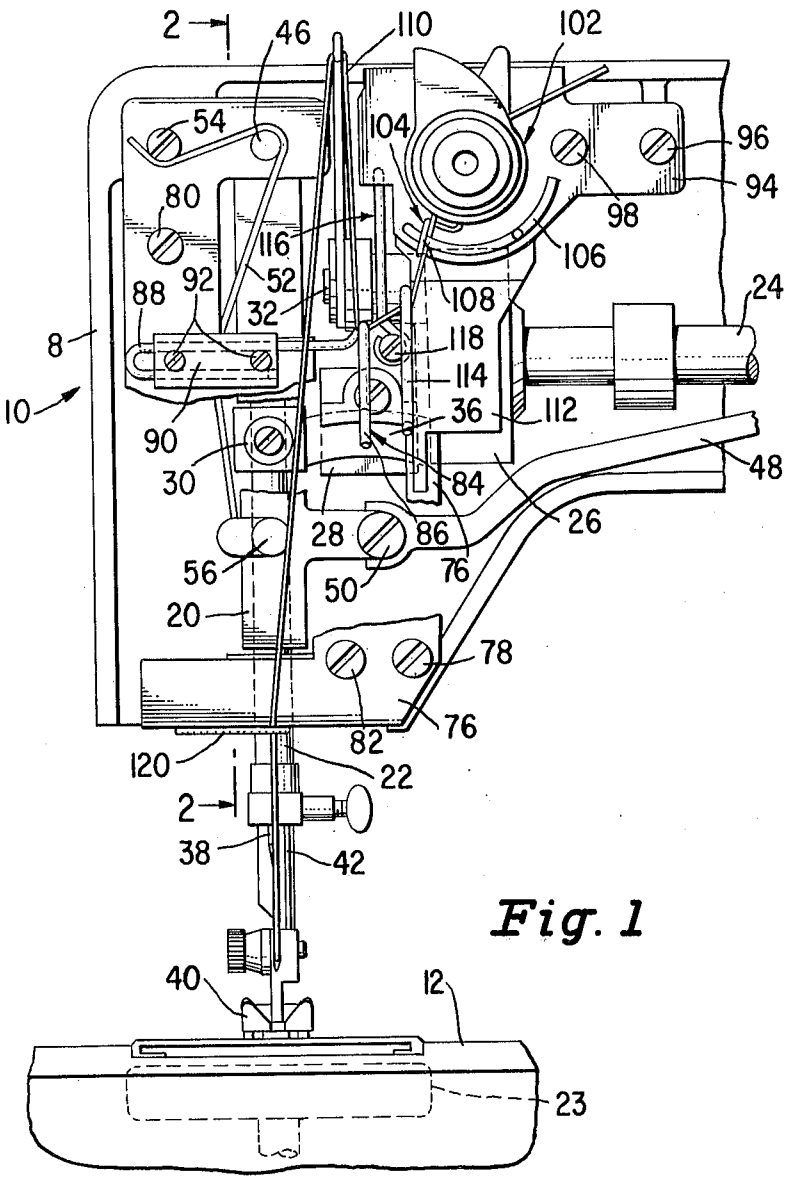
FIG. 1 is a front elevational view of the head end portion of a sewing machine bracket arm, partially broken away, with the front cover plate removed, and equipped with means for thread control and handling in accordance with the present invention.

A further flat rigid plate 94, which is also part of the presser and needle bar sub-assembly, is secured, as by a screw 96 to the rear casing section 8 and by a screw 98 to the fixed support bracket 14. Mounted on the further rigid plate 94 is a rotatably adjustable thread tensioning device 102 of conventional construction and including a check spring 104, also of conventional design. The further rigid plate 94, generally adjacent the tensioning device 102 is provided with a thread guide 106 of generally U-shaped configuration which is curved, as shown in FIG. 1, so as to be generally concentric with the thread tensioning device 102 and which passes through a loop or bight portion 108 of the check spring 104 to guide a needle thread 110 about (i.e., to the right as viewed in FIG. 1) the loop portion 108 of the check spring 104, as shown.

Further, the flat rigid plate 94 carries a generally planar downwardly depending thread supporting surface 112 upon which is mounted an additional thread guide 114 of generally inverted U-shape configuration generally parallel and spaced apart from the thread guiding portion 86 of the thread guide 84. The guide 114 may, as shown, be fabricated of formed wire. A gap exists between the thread guides 84 and 114, as shown, into which a thread controlling and metering means, such as a cam or device 116 is adapted to be cyclically moved for controlling and metering slack in the needle thread 110 as the take-up lever 64, and particularly the eyelet 68 carried on the arm 66 thereof, initially descends, so as to prevent the needle thread 110 from wrapping around the point of the needle 38 prior to needle penetration. The cam or device 116 may be fabricated, for example, of sheet like material such as sheet steel or may, preferably, as shown, be fabricated of formed wire.

The thread control and metering cam or device 116 is cyclically advanced between the two stationary thread guides 84 and 114 and retracted therefrom, to vary the length of the thread path, by being mounted to and for movement with, the needle bar connecting link 28, as by means of a screw 118, so as to only engage the thread 110 as the take-up 64 and needle bar 22 descend.

In normal sewing, the path of the thread to the needle 38 occurs from a supply spool, not shown, to the thread tensioning device 102, behind the bight 108 of the check spring 104 and between the legs of the thread guide 106, thence to the stationary thread guide 114, across the gap in line with the thread control and metering cam or device 116, thence around the thread guiding portion 86 of the thread guide 84 to the eyelet 68 of the thread take-up lever 64 and then to the needle eye, as by being passed through a further thread guide 120 at the lower end portion of the bracket arm head end portion 10.

Yet further, there may be provided a protective guard 122 of transparent plastic, or the like, in front of the stationary thread handling guides 114 and 84, thread control and metering cam 116, and check spring 104.

Figure 4:
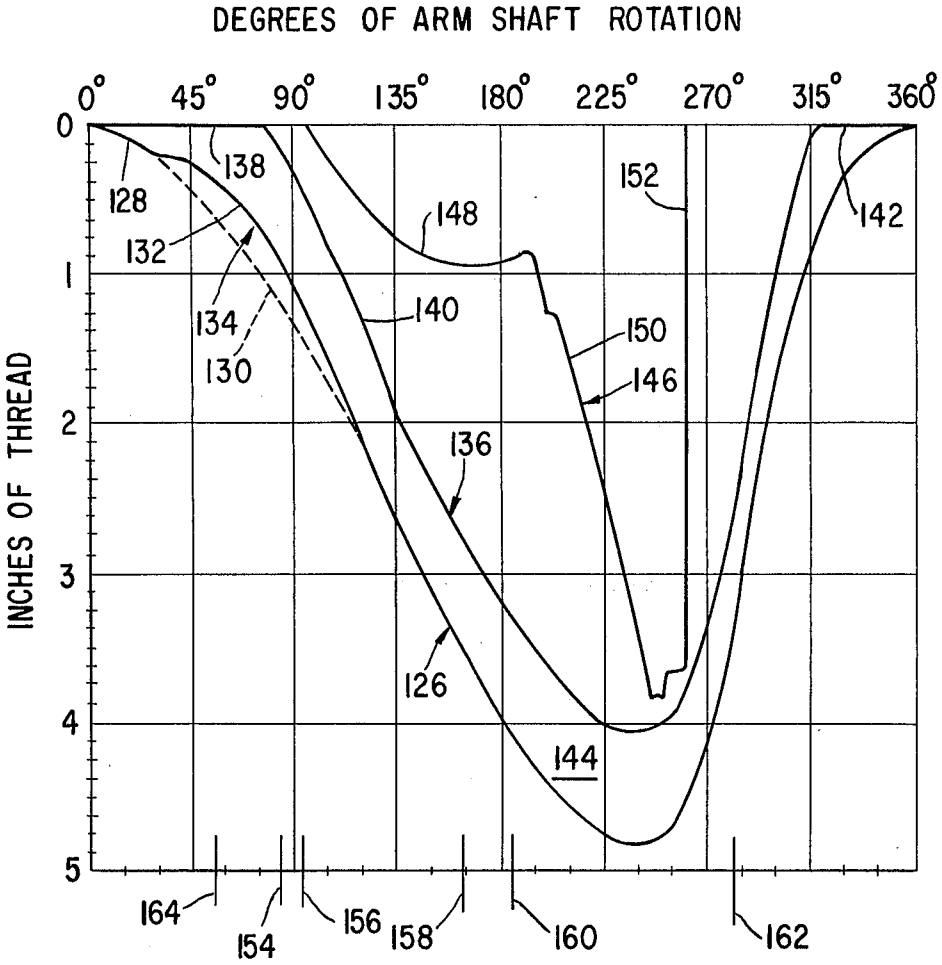
FIG. 4 is a graph illustrating the thread demand of the needle and loop taker compared with the thread supplied by the take-up, thread controller and metering device, and the check spring.

Referring now particularly to FIGS. 1 and 2, wherein the needle bar 22 and the thread take-up lever 64 are shown in their uppermost positions, it will be seen that at the start of the machine cycle, as the needle bar 22 and take-up lever 64 start their descent (the arm shaft 24 rotating in the clockwise direction as seen in FIGS. 2–4) the thread path is from the tensioning device 102 substantially directly to the stationary thread guide 114 and the check spring 104 is stressed and has rotated the bight or loop 108 thereof counterclockwise so as to pay out needle thread 110 under some tension since the take-up has just set the preceding stitch. From the stationary guide 114 the needle thread 110 passes directly to the thread guide portion 86 of the other stationary thread guide 84 around which the thread is capstaned upwardly to the eyelet 68 of the thread take-up 110 where it is again capstaned through almost 360 degrees and thence downwardly to the needle 38. As shown most clearly in FIG. 2, in this position the thread controller and metering cam or device 116 does not contact the needle thread 110 and is therefore inactive. As the arm shaft 24 rotates (clockwise in FIGS. 2 and 3), the needle bar connecting link 28 is progressively tilted toward the right (in FIGS. 2 and 3) as the crank pin 32 of the counterbalanced crank 26 sweeps downwardly and to the right until the thread controlling and metering cam 116 passes outwardly of the thread supporting surface 112 and between the stationary thread guides 114 and 84, a condition which commences after about 30 degrees of arm shaft rotation. As the arm shaft and counterbalanced crank 26 continue to rotate, the take-up lever 64 continues to descend paying off needle thread 110 at a rate faster than the needle bar 22 is descending creating slack in the needle thread 110. Simultaneously, however, the thread controlling and metering cam or device 116 progressively projects further and further past the thread supporting surface 112 and outwardly of the stationary thread guides 114 and 84, pushing the needle thread 110 further and further outwardly until a maximum amount of slack thread has been absorbed in the elongated path from the stationary guide 114 over the projecting thread controlling and metering cam 116 to the other of the stationary thread guides 84 after about 75 degrees of arm shaft rotation. The thread controller and metering cam or device 116 comprises a generally linear portion or surface 124 which remains in engagement with the needle thread 110 for about 15 degrees of arm shaft rotation so as to hold the maximum amount of thread during this part of the cycle, as shown in FIG. 3. Simultaneously, additional slack is taken up by the check spring 104, the loop or bight 108 of the check spring 104 moving towards the right (as viewed in FIG. 1). The position shown in FIG. 3 is the position just before needle penetration.

After the needle penetrates the fabric, the continued rotation of the arm shaft 24 and counterbalanced crank 26 progressively withdraws the thread controlling and metering cam 116 from between the fixed guides 114 and 84 and this withdrawal of the thread control and metering cam 116 accordingly meters out needle thread to the needle 38 so as to provide sufficient thread for formation of a loop for seizure and loop expansion by the rotary hook loop taker 23. Once the arm shaft 24 and counterbalanced crank 32 have rotated sufficiently to withdraw the thread controlling and metering cam 116 from between the stationary guides 114 and 84, a condition that exists after approximately 120 degrees of arm shaft rotation, for the remainder of the arm shaft cycle the thread control and metering cam 116 is inactive. During the inactive period it is merely moving with the needle bar connecting link within the bracket arm, moving even further in as the crank pin 32 of the counterbalanced crank 26 passes the bottom dead center position of maximum needle penetration and starts raising the needle, while the take-up lever 64 continues to pay out needle thread to the loop taker for loop expansion as the rotary hook loop taker 23 carries the loop around the bobbin case (not shown) for stitch concatenation around the bobbin thread as the loop approaches cast off from the loop taker, which occurs at approximately 255 degrees of arm shaft rotation, the take-up lever 64 and, particularly, the eyelet 68 carried on the distal end of the arm 66 is at its lowest most point in its orbital travel, and ready to commence thread take-up for loop extraction following cast off from the loop taker to pull up and set the stitch.

As the loop taker approaches cast off, the take-up lever 64 with the thread eyelet 68 is in its lowermost position and the eyelet 68 and the stationary thread guides 114 and 84 are in substantially a straight line with the needle thread 110 falling generally freely therethrough, generally downwardly and to the left side, as shown, the stationary guide 114 being higher than stationary guide portion 86 and in line between the guide 86 and the check spring 104. The take-up eyelet 68, on the other hand, is generally below the stationary thread guide portion 86 and in line therewith so that a needle thread 102 at this point in time descends generally linerally through the guides 114, 86 and the eyelet 68 towards the needle with minimal capstaning or wrapping of thread around either the stationary guides 114 or 86 or around the take-up lever eyelet 68. Hence, at this point in time, that is, as the loop approaches cast off from the loop taker and when it is drawn between the bobbin case stop and the case positioning plate, the thread is under minimal tension, being in a straight line from the check spring downwardly through the guides and eyelet so as to reflect little distortion to the stitch concatenation process.

As the arm shaft continues rotation, the take-up lever 64 rises, extracting the loop and enabling the stitch to be pulled up and set.

FIG. 4 graphically illustrates the coordination of thread demand by the needle and loop taker with the thread supply from the take-up and check spring and how the thread control and metering device of the present invention modifies the thread supply so as to coordinate the thread supply closely with the thread needs or demand of the needle and loop taker. in FIG. 4 the time, in degrees of arm shaft rotation from top dead center at the left of the graph for a full 360 degrees of arm shaft rotation back to top dead center again at the right of the graph, are indicated along the horizontal axis, in degrees of arm shaft rotation, while the amount of thread, in inches, supplied or demanded is indicated along the vertical axis.

The lowermost curve, designated generally by the reference character 126 shows the supply of thread from the take-up 64 as modified by the thread control and metering device or cam 116. Starting at the upper lefthand corner of the graph, at 0 degrees arm shaft rotation (top dead center), the thread supply also, by definition starts at zero. For the first 30 degrees of arm shaft rotation, as indicated by the line segment 128, the thread take-up starts to descend, supplying thread. From 30 to about 115 degrees, the thread controller and metering device or cam 116 becomes active and the supply from the thread take-up 64 is indicated by the dashed line segment 130 while the actual thread supply provided by the take-up 64 combined with the thread control and metering device or cam 116 is indicated by the solid line segment 132. The thread taken up by the thread controller and metering device or cam 116 is indicated by the space between the dotted line segment 130 and the solid line segment 132, as indicated by the reference character 134.

The next curve, designated generally by the reference character 136 indicates the actual thread supply with the check spring being added to the system to provide automatic coordination of the thread supply to the thread demand as needed for proper stitch formation. From 0 to about 80 degrees of crank shaft rotation, as indicated by the line segment 136, the check spring 104 takes all slack out of the system, as the check spring expands and the bight or loop 108 thereof moves to the right lengthening the path between the tensioning device 102 and the fixed thread guide 114. At this point, penetration occurs and the check spring being fully relaxed, the thread supply, indicated by the line segment 140 generally parallels the line 126 until after about 315 degrees of arm shaft rotation, the check spring commences taking up thread, as indicated by the line segment 142.

The space between the curves 126 and 136, designated by the reference character 144, corresponds to the amount of slack taken by the check spring 104.

The final curve, designated generally by the reference character 146 indicates the needle bar and loop taker demand. The line segment 148 indicates the needle bar demand, starting from eye penetration at about 97–98 degrees after the needle bar reaches its lowermost position, and starts to rise, the upcurve indicates loop formation, followed by loop seizure at about 190 degrees and the line segment 150 indicates the loop taker demand until cast off at about 260 degrees rotation, as indicated by the line segment 152. The area between curves 136 and 146 indicates the presence of slack in the system which is taken up by loop expansion prior to cast off and loop extraction following cast off.

Point penetration is indicated on the graph, in FIG. 4 by the reference character 154, eye penetration is indicated by the reference character 156, needle bar down by the reference character 158, loop seizure by the reference character 160, feed beginning by the reference character 162 and feed ending by the reference character 164.

Accordingly, in accordance with the present invention the needle thread is controlled to prevent slack which might foul the needle prior to needle penetration, following needle penetration the needle thread is payed out by the thread controlling and metering device to meet the needle thread demand. Moreover, as loop cast off approaches, the tension applied to the needle thread is minimal.

I claim:

1. In a lockstitch sewing machine having an armshaft driving an eye pointed needle carrying needle bar through a needle bar drive link pivotally connected at one end portion with the needle bar and at the other end portion with an orbiting crank pin carried by a counterbalanced crank rotated by the arm shaft, a take-up lever comprising a needle thread take-up operated by the counterbalanced crank and a rotary loop taker driven at a three-to-one rotational ratio relative the arm shaft and operatively associated with the needle for cooperation therewith to concatenate a series of type 301 lockstitches about a needle thread carried by the eye pointed needle, means operatively associated with the needle bar drive link for controlling needle thread slack only during descent of the needle thread take-up taking up thread prior to needle penetration to prevent slack needle thread from being wound about the needle point and for metering said needle thread slack back out to the needle following needle penetration to provide slack for loop formation and comprising a controlling and metering cam carried by said needle bar drive link to be projected by movement thereof into path lengthening engagement against said needle thread as the needle bar descends.

2. The sewing machine defined in claim 1 wherein said means further comprises a pair of fixed thread guides positioned laterally on either side of said cam defining a gap therebetween into which said cam moves to control needle thread slack prior to needle penetration and out of which said cam subsequently moves to meter out thread to the needle.

3. The sewing machine defined in claim 2 wherein said cam comprises a formed wire having a generally lineraly extending portion to provide a period of maximum thread control.

4. The sewing machine defined in claim 3 wherein said arm shaft is journalled for rotation within a bracket arm, said fixed thread guides being mounted with said bracket arm.

5. A lockstitch sewing machine comprising, in combination, an armshaft, an eye pointed needle carrying needle bar, a needle bar drive link pivotally connected at one end portion with said needle bar and at the other end portion with an orbiting crank pin carried by a counterbalanced crank rotated by said arm shaft, a take-up lever operated by the counterbalanced crank including a needle thread take-up and a rotary loop taker driven at a three-to-one rotational ratio relative said arm shaft and operatively associated with the needle for cooperation therewith to concatenate a series of type 301 lockstitches about a needle thread carried by the eye pointed needle, together with means operatively associated with the needle bar drive link for controlling needle thread slack only during descent of the needle thread take-up to take up thread prior to needle penetration to prevent slack needle thread from being wound about the needle point and for metering said needle thread slack back out to the needle following needle penetration to provide slack for loop formation comprising a controlling and metering cam carried by said needle bar drive link to be projected by movement thereof into path lengthening engagement against the needle thread as said needle bar descends.

6. The sewing machine defined in claim 5 wherein said means further comprises a pair of fixed thread guides positioned laterally on either side of said cam defining a gap therebetween into which said cam moves to control needle thread slack prior to needle penetration and out of which said cam subsequently moves to meter out thread to the needle.

7. The sewing machine defined in claim 6 wherein said cam comprises a formed wire having a generally linearly extending portion to provide a period of maximum thread control.

8. The sewing machine defined in claim 7 wherein said arm shaft is journalled for rotation within a bracket arm, said fixed thread guides being mounted with said bracket arm.

9. Method of thread control and metering for a type 301 lockstitch sewing machine having an arm shaft driving an eye pointed needle carrying needle bar through a needle bar drive link pivotally connected at one end portion with the needle bar and at the other end portion with an orbiting crank pin carried by a counterbalanced crank rotated by the arm shaft, a take-up lever comprising a needle thread take-up operated by the counterbalanced crank and a rotary loop taker driven at a three-to-one rotational ratio relative the arm shaft and operatively associated with the needle for cooperation therewith to concatenate a series of type 301 lockstitches about a needle thread carried by the eye pointed needle to prevent slack thread from wrapping around the needle prior to needle penetration, the method comprising at least the steps of, carrying thread control and metering cam by the needle bar drive link for movement therewith, mounting a pair of thread guides fixedly externally on either side of the cam with a gap therebetween into which the cam may be projected to increase the thread path so that as the needle bar descends the cam will be projected outwardly between a fixed needle guide, and rotating the arm shaft to move such cam into and out of engagement with the thread only as the needle bar descends.

* * * * *